United States Patent [19]

K-Gall

[11] 4,160,058

[45] Jul. 3, 1979

[54] WATERPROOF COVERING DEVICE, ESPECIALLY FOR TERRACES, AND METHOD FOR MANUFACTURING SAME

[76] Inventor: Jean-Yves K-Gall, 26, rue de l'Eglise, 92200 Neuilly-sur-Seine, France

[21] Appl. No.: 752,547

[22] Filed: Dec. 20, 1976

[30] Foreign Application Priority Data

Dec. 23, 1975 [FR] France ..... 75 39578
Aug. 30, 1976 [FR] France ..... 76 26166

[51] Int. Cl.[2] ..... B23B 3/26; E02D 27/00; B32B 5/18; D04H 1/00

[52] U.S. Cl. ..... 428/286; 52/169.14; 52/309.17; 427/136; 427/209; 428/74; 428/57; 428/247; 428/246; 428/254; 428/262; 428/265; 428/269; 428/284; 428/287; 404/82

[58] Field of Search ..... 52/169.14, 309.17; 428/246, 247, 251, 252, 284, 285, 286, 295, 74, 262, 269, 320, 321, 322; 404/31, 32, 66, 67, 82; 61/1 R, 7, 35

[56] References Cited

U.S. PATENT DOCUMENTS

| | | | |
|---|---|---|---|
| 2,653,118 | 9/1953 | Seymour | 52/309.17 |
| 2,718,829 | 9/1955 | Seymour et al. | 52/309.17 |
| 2,752,275 | 6/1956 | Raskin et al. | 52/309.17 |
| 2,983,624 | 5/1961 | Thompson | 428/251 |
| 3,364,058 | 1/1968 | Wagner et al. | 404/31 X |
| 3,725,185 | 4/1973 | Curtis | 52/309.17 |
| 3,853,682 | 12/1974 | Hurst | 428/40 |

FOREIGN PATENT DOCUMENTS

| | | | |
|---|---|---|---|
| 2450946 | 2/1975 | Fed. Rep. of Germany. | |
| 1194640 | 5/1959 | France | 52/309.17 |
| 2178355 | 11/1973 | France. | |
| 2194208 | 3/1974 | France. | |

*Primary Examiner*—George F. Lesmes
*Assistant Examiner*—D. R. Zirker
*Attorney, Agent, or Firm*—Browdy & Neimark

[57] ABSTRACT

A waterproof covering is manufactured by depositing a fluid product, forming an adhering and watertight film, on the surface of the basis or support to be waterproofed. A textile layer is laid on the film before its complete formation, i.e., while a portion of the film forming fluid is still in its fluid state, in such a way that the central portion of this layer is not impregnated and a second fluid forming an elastic waterproof film is laid on the textile in such a way that the central portion of the textile layer is not impregnated. The roll of material used in this process is also disclosed as well as is thewaterproof covering obtained by this process and its use to waterproof terraces, front walls, foundation walls, tanks or the like.

31 Claims, No Drawings

WATERPROOF COVERING DEVICE, ESPECIALLY FOR TERRACES, AND METHOD FOR MANUFACTURING SAME

The problem of the waterproofing of slightly sloped or slopeless shapes is difficult to solve. It is the case with terraces, whether the support comprises concrete slabs, wooden panels, steel or aluminum tanks, etc..

In the case of a terrace, the ground thereof is traditionally covered by one or more often, several thick coats of an asphaltic or bituminous product. Th bituminous or asphaltic products being easily subject to cracking, felt is usually imbedded into them.

Due to the bad adherence of the bituminous or asphaltic products to the supports, this covering must itself be covered by a capping acting by its weight, for example a bed of pebbles or the like, to prevent the lifting of the covering from the support and its creep or flow under the action of heat.

It has been suggested to provide waterproofing by using thin coverings made of other materials. Some are realized on the spot and adhere to the support, but they are sensitive to the cracking of the support.

Others are constituted of strips prepared in advance and are not adhesive. The assembly of these strips requires then the utmost care, in particular at angles and at raised portions, and their maintaining in position requires a heavy protection.

Some of these techniques use a reinforcement made from textile or glass mat, but experience shows that none bring a satisfactory solution to the complex problem of preserving imperviousness to water in spite of cracking.

The attempts to use a "skin" derived from a polyester resin reinforced with glass fiber or with a textile have not lead to success because of their relative fragility. Imperviousness disappears as soon as cracks appear in the base, which is frequent when this base is made of concrete, these cracks causing the waterproof covering to break-up.

In all these cases also, the waterproof coverings do not lend themselves easily to support the traffic of pedestrians or vehicles.

It has already been suggested to use a textile at the under side and, at the upper side, a product allowing traffic. But such a covering can only be used inside premises and as an insulating means. It is incapable of insuring imperviousness to water, particularly at the junction of the textile strips.

The waterproof covering device according to this invention comprises a textile core covered on its external side with a waterproof pellicule or film. The textile core is united with the support or basis, for example made of concrete or similar, through a film, preferably also waterproof and elastic.

The covering device according to this invention belongs to the type of those which are prepared on the spot, which enables one to obtain good adherence of a textile to the support and simple application on all difficult places: portions raised in acroteria, chimney stubs, etc.

Placing textile material strips on the continuous film adhering to the basis does not introduce any discontinuity into the waterproofing, and the waterproof covering film or pellicle deposited onto the textile provides an external continuous elastic waterproof skin.

An important characteristic of this invention lies in the fact that there remains, between the internal pellicle providing a link with the support or basis and the external pellicle impervious to liquids, a portion of non impregnated textile, and it is to the presence of this non impregnated textile portion, which has retained its flexibility, that can be attributed the particular property of the device according to this invention, i.e. to insure continuous waterproofing in spite of crackings, even important ones, in the support on which it is established.

To manufacture the covering device, a fluid material which will produce a film is brought on the surface of the basis or support which is to be waterproofed, and before the completion of the film, that is to say when a part of the material brought is still in its fluid state, a textile layer is laid down on it and a fluid material which will give an impervious film is brought on the textile layer.

According to another embodiment, a layer of textile comprising on its surface, resulting from its manufacturing, a waterproof pellicle, is laid on the fluid material which provides a film and which is brought on the basis or support.

The manufacturing operation on the spot can hence be carried out very quickly, as it is limited to applying the fluid material on the support and bringing on the fluid material, the textile layer already comprising the surface waterproof pellicle.

The textile layer is usually available under the shape or rolls or strips. These can have a large width, in the order of 4 to 5 meters.

Waterproofing is completed along the butting-joints or along the overlapping joints by using the same material as the one providing the impervious pellicle, said material being advantageously applied, with overlapping, either in a liquid form, or in a ribbon form.

The fact that the impervious pellicle, which is to provide the external surface of the covering, is factory produced allows one to ensure a regular quality independent of the skill of the worker realizing the application on the spot.

Furthermore, this way of execution allows one to easily use different materials in order to realize the impervious external pellicle and the film or pellicle brought on the basis or support.

The covering device according to this invention is easy to manufacture and its cost price is low. It has better characteristics than those of waterproof coverings known up to this day.

The thickness of the non-impregnated central part of the textile layer, and the relative thickness of the fixing pellicle and of the impervious external pellicle can vary inside wide limits without the covering having its fundamental property modified.

The covering device is moreover remarkable by the fact that it is adapted to receive a coating the physical characteristics of which: hardness, high resistance, etc., are effective to support pedestrians and/or vehicular traffic. Such a coating is insensitive to cracking of the support, while being integral with the assembly constituted by the support and its waterproof covering.

A thin coating for traffic can thus be applied, for example made from resin mortar, giving rise to a waterproof covering, supporting traffic, which is not thick.

Even if the traffic-supporting cover cracks, independently from the support, the elastic waterproof continuous coating on which it is secured being not integral on its under side with another non elastic material, can support the corresponding elongations without losing its continuity, and thus continue to insure the imperviousness of the piece of work.

EXAMPLE

A film or thin skin of an aqueous emulsion of high acrylic polymers, for example that sold under the name of DAKFILL and manufactured by Usines Martin Mathys S.A. of Zelem, Belgium, is applied on a support, for example of concrete.

The application can be made with a brush, a roller or a pistol.

The pellicle thus obtained adheres to the support, for example to concrete.

In another embodiment, the fluid material comprises an organic volatile solvent.

Before the emulsion is completely broken, when it is still fresh, textile sheets are unrolled, for example sheets of non woven fabric of polyester fibers, such as that manufactured and sold by RHONE-POULENC under the name of "BIDIM." Good results have obtained with "BIDIM" weighing 110 grams per square meter.

The sheets, which offer a great resistance to traction and a great flexibility, are placed in strips, side by side, the strips being edge to edge, and without taking any particular precautions.

The strips can be placed slightly overlapping, the overlapping portions being glued one to the other for example with the same product as the one used for the securing of the textile sheet to the support.

As an alternative, the adjacent edges of the strips can also be assembled by sewing, soldering or any other means.

The water from the emulsion can continue to evaporate through the textile until the emulsion is completely broken.

A waterproof film or pellicle is then formed onto the textile layer. According to this invention, the product, which must not wet the textile, is deposited in such a manner that it does not penetrate the whole thickness of the textile layer.

In this respect it has been found that deposition by means of a projection pistol was appropriate.

A high pressure pistol can be used, but the projection nozzle must be kept sufficiently far from the textile sheet for the emulsion to deposit in the form of small droplets without penetrating through the whole thickness of the textile portion non impregnated by the underlying pellicle. It has been found that, in these conditions, by continuing the projection, a waterproof layer of any desired thickness can be produced.

It is to be thought that, because of its division into small particles, the product initially projected hardens or solidifies quickly enough onto the textile fibers to create very rapidly a skin which then opposes itself to any further penetration of the projected liquid.

In covering devices having given good results, the lower quarter of the thickness of the non-woven fabric was impregnated with the product insuring integrality with the support, which is enough to insure the sticking of the whole of the textile sheet, and the upper quarter of the thickness of the fabric was impregnated with the product forming the skin as extra thickness, insuring a perfect waterproofing and a good elasticity.

Preferably the same product as that used to obtain adherence onto the support can be used to form the external pellicle, DAKFILL in the example.

The desired waterproof covering is obtained as soon as the projected emulsion is completely broken.

It has been found that the covering device continues to insure waterproofing even when the underlying support, for example concrete, cracks, even if the crack reaches one millimeter or more.

It is to be thought that the continuity of the upper waterproof pellicle remains insured because of the flexibility of the non impregnated textile material which exists inside the covering and which, in a certain manner, absorbs the positional variations of the support, and that, even if the thickness of the elastic layer is relatively small, with the benefit of a low cost price.

On the thus obtained covering device can be deposited a coating of resin with fillers, such as that manufactured in Spain by the firm COMPOSAN S.A. in Madrid and sold there under the name of "SLURRY COLOR" and also sold in France under the name of MATCODAL, resin which, with a relatively small thickness, in the order of 2 to 3 mm, forms a cover which permits the traffic of pedestrians and/or motor vehicles: it is thus possible to use such a cover, which in itself has very little resistance to cracking.

A concrete cover can also be deposited.

The device can be constituted from other textiles than that described in the example, woven or non-woven, or knitted, natural, artificial, or mineral.

The covering device can have a thickness comprised between 0.5 and 5 mm.

It is resistant to pull.

It can be placed on a horizontal surface even having steps.

It can also be placed on a sloped surface, with a slope up to 90°.

The device can call for different products than those described to constitute the waterproof films or pellicles, as far as such products present the characteristics defined hereabove.

This invention provides also to manufacture the covering device not directly on the support itself, such as a concrete pavement, but on thermic insulation panels previously secured onto the support.

The covering device offers then the supplementary advantage of making up for the eventual dimension differences of the insulation panels placed side by side.

These panels can be of rigid or semi-rigid type.

The covering device according to this invention can also be used on a front wall, or other wall, or on a foundation wall.

It can also be used on a fluid tank.

What I claim is:

1. A waterproof covering on a base or support, including a base or support and a waterproof covering thereon, said waterproof covering comprising:

a first thin continuous pellicle adhering to the base or support;

a textile layer on said first pellicle having a portion of its thickness impregnated by the material constituting said first pellicle and another portion of its thickness non-impregnated thereby; and on the face of said textile layer opposite to the face coming in contact with said first pellicle, a second continuous watertight pellicle impregnated into said textile layer a distance sufficiently thin to leave a portion of the thickness of the textile layer non-impregnated by both the material constituting said first pellicle and the material constituting said second pellicle, said non-impregnated portion of the textile layer being sufficiently thick to preserve the external pellicle from excessive mechanical stress in case of cracking of the base or support.

2. The waterproof covering according to claim 1, wherein said first and second pellicles are obtained from the same material.

3. The waterproof covering according to claim 1, wherein the textile layer is a non-woven fabric.

4. The waterproof covering according to claim 1, wherein said first and second pellicles are obtained from different materials.

5. A waterproof covering according to claim 1, wherein the non-impregnated portion of the textile layer has a thickness substantially equal to half the total thickness of said textile layer.

6. A waterproof covering according to claim 1, wherein the textile is made from synthetic fibers.

7. A waterproof covering according to claim 1, wherein the portion of the textile impregnated with material constituting said first pellicle and the portion of the textile impregnated with material constituting said second pellicle have substantially the same thickness.

8. A waterproof covering according to claim 1, wherein the textile is made from natural fibers.

9. A waterproof covering according to claim 1, wherein the textile is a non woven fabric of polyester fibers.

10. A waterproof covering according to claim 1, wherein at least one of the films is formed from a fluid changing, through evaporation, into a waterproof elastic pellicle.

11. A waterproof covering according to claim 10, wherein the fluid is an emulsion.

12. A waterproof covering according to claim 11, wherein the emulsion is an aqueous emulsion.

13. A waterproof covering according to claim 12, wherein the aqueous emulsion is of high acrylic polymers.

14. A waterproof covering according to claim 1, wherein the textile layer comprises a plurality of juxtaposed strips of textile.

15. A waterproofed terrace, front wall, foundation wall, tank or the like comprising a terrace, front wall, foundation wall, tank or the like covered with the covering according to claim 1.

16. A terrace according to claim 15, comprising above the waterproof covering a thin layer or filled resin.

17. The terrace according to claim 16, wherein the covering device is formed on thermic insulation panels previously secured on the support.

18. The terrace according to claim 15, wherein above the waterproof covering device a concrete slab is provided.

19. A waterproof covering in accordance with claim 1, wherein said first thin continuous pellicle adhering to the base or support is itself watertight.

20. A process for manufacturing a waterproof covering on a basis or support comprising:

depositing a first fluid, film-forming product onto the surface of the basis or support to be waterproofed, said film-forming product being one in which the formed film is adhering and continuous;

before said first film-forming product completes film formation, while a portion thereof is still in the fluid state, laying a textile layer onto said first film-forming product in such a way that a portion of said textile layer becomes impregnated with said first product but the central portion of said textile layer does not become impregnated with said first product; and depositing a second fluid, film-forming product onto said textile layer in such a way that a portion of said textile layer opposite that portion impregnated with said first product becomes impregnated with said second product but the central portion of said textile layer is not impregnated, said second film-forming product being one in which the formed film is an elastic waterproof film.

21. The process according to claim 20, wherein the second fluid product is an aqueous emulsion.

22. The process according to claim 21, wherein the aqueous emulsion is of high acrylic polymers.

23. The process according to claim 20, wherein the second fluid product is a solution in a volatile solvent.

24. The process according to claim 20, wherein the second fluid fluid is deposited onto the textile by projection with a pistol.

25. A process in accordance with claim 20, wherein said first fluid, film-forming product is one in which the formed film is watertight.

26. A process for manufacturing a waterproof covering or a basis or support, comprising:

depositing a first fluid, film-forming product onto the surface of the basis or support to be waterproofed, said film-forming product being one in which the formed film is adhering and continuous; and before said first film-forming product completes film formation, while a portion thereof is still in the fluid state, laying a textile layer onto said first film-forming product in such a way that a portion of said textile layer becomes impregnated with said first product but the central portion of said textile layer does not become impregnated with said first product, wherein said textile layer has, on the surface thereof opposite that surface laid on said first product, an elastic watertight film thereon, said film impregnating a sufficiently thin portion of said textile layer to leave the central portion of the thickness of the textile layer non-impregnated.

27. A process in accordance with claim 26 wherein said textile layer having an elastic watertight film thereon is produced prior to said depositing step by:

depositing a second fluid, film-forming product onto said textile layer in such a way that a portion of said textile layer becomes impregnated with said second product but the central portion of said textile layer is not impregnated, said second film-forming product being one in which the formed film is said elastic watertight film.

28. A process in accordance with claim 27 further including, after said step of depositing a second fluid film-forming product onto said textile layer, rolling the so produced textile layer having an elastic watertight film thereon into a roll, and wherein said laying step includes unrolling said roll of textile layer onto said deposited first product.

29. A process in accordance with claim 26 wherein said step of laying said textile layer comprises laying in a juxtaposed relationship, with butting or overlapping joints, a plurality of strips of said textile having an elastic watertight film thereon, and further including the step of waterproofing said joints.

30. The process according to claim 29, wherein said waterproofing of said joints is made with the same material which constitutes said elastic waterproof film.

31. A process in accordance with claim 26, wherein said first fluid, film-forming product is one on which the formed film is watertight.

* * * * *